US007878958B2

(12) United States Patent
Hockemeyer

(10) Patent No.: US 7,878,958 B2
(45) Date of Patent: Feb. 1, 2011

(54) WEIGHTLIFTING SYSTEM WITH SPOTTER PLATFORM

(75) Inventor: Timothy John Hockemeyer, Midland, MI (US)

(73) Assignee: Rogers Athletic Company, Clare, MI (US)

( * ) Notice: Subject to any disclaimer, the term of this patent is extended or adjusted under 35 U.S.C. 154(b) by 861 days.

(21) Appl. No.: 11/326,038

(22) Filed: Jan. 5, 2006

(65) Prior Publication Data

US 2007/0155597 A1 Jul. 5, 2007

(51) Int. Cl.
*A63B 26/00* (2006.01)

(52) U.S. Cl. ..... 482/142

(58) Field of Classification Search ..... 482/19, 482/43, 79, 104, 107, 142; D21/662, 686, D21/690, 694–695; *A63B 21/00, 17/02, A63B 26/00*

See application file for complete search history.

(56) References Cited

U.S. PATENT DOCUMENTS

| | | | | |
|---|---|---|---|---|
| 4,729,561 | A * | 3/1988 | Desjardins | 482/104 |
| 4,861,024 | A | 8/1989 | Lee | |
| 5,215,510 | A | 6/1993 | Baran | |
| 5,649,886 | A * | 7/1997 | Danylieko | 482/142 |
| 5,669,859 | A | 9/1997 | Liggett et al. | |
| 5,954,619 | A * | 9/1999 | Petrone | 482/104 |
| D444,827 | S | 7/2001 | Mobley | |
| 6,605,023 | B1 | 8/2003 | Mobley | |
| 6,623,407 | B2 | 9/2003 | Novak et al. | |
| 6,623,409 | B1 | 9/2003 | Abelbeck | |
| 6,669,607 | B2 | 12/2003 | Slawinski et al. | |
| 6,905,446 | B2 * | 6/2005 | Greenland | 482/100 |
| 7,112,162 | B2 * | 9/2006 | Greenland | 482/94 |
| 7,753,830 | B1 * | 7/2010 | Marsh et al. | 482/142 |
| 2003/0050157 | A1 * | 3/2003 | Teuscher | 482/142 |

* cited by examiner

*Primary Examiner*—Loan Thanh
*Assistant Examiner*—Oren Ginsberg
(74) *Attorney, Agent, or Firm*—Carlson, Gaskey & Olds, PC

(57) ABSTRACT

A weightlifting system includes a spotter platform which flanks a weight bench. The spotter platforms provide a surface raised above the base upon which a spotter may stand. The spotter platform may be articulated to a vertical stowed position to clear an area on the base for other exercises. The spotter platforms also provide fixed receipt areas within which the weight bench is received to provide proper weightlifter positioning while minimizing any relative movement between the weight bench and the weight bar frame rack.

10 Claims, 9 Drawing Sheets

WEIGHTLIFTING SYSTEM WITH SPOTTER PLATFORM

BACKGROUND OF THE INVENTION

The present invention relates to weightlifting equipment, and more particularly to a spotter platform which receives a weight bench.

Weightlifters perform various exercises for the purpose of developing particular muscles throughout the body. These exercises can be performed through the use of free weights, such as barbells, or with machines. Many weightlifters prefer free weights because free weights permit the lifter to perform the exercises in a natural motion while utilizing pure body leverage in performing the exercise. This facilitates isolation of particular muscle groups and simulates actual athletic sports motions.

Oftentimes when utilizing free weights, particularly when performing exercises on a weight bench, a spotter assists the weightlifter. The spotter stands behind the weightlifter—adjacent his head—while the weightlifter is lying on the weight bench. The spotter typically assists the weightlifter with the few final repetitions in each set such that the weightlifter is able to continue lifting past the fatigue point at which he would no longer be able to lift the current weight unassisted. The spotter thereby maximizes the weightlifters work out for that exercise.

As the spotter is standing on the floor, the spotter oftentimes must straddle the weightlifters head. Aside from being a somewhat uncomfortable position, the spotter also has reduced leverage to assist the weightlifter should assistance be required and the spotter is required to lift a significant portion of the weight. This may be of particular concern while spotting for a weightlifter that is bench pressing significant weight.

Accordingly, it is desirable to provide a weightlifting system that will better position the spotter while spotting the weightlifter.

SUMMARY OF THE INVENTION

A weightlifting system according to the present invention includes a spotter platform which flanks a weight bench. Each spotter platform is preferably attached to a base between upright frame members of a weight bar frame rack. The spotter platforms provide a surface raised above the deck upon which a spotter may stand. The spotter platforms provide a more comfortable position for both the spotter and the weightlifter while providing a leverage advantage to the spotter such that the spotter may more readily lift with his legs during spotting of the weightlifter. The spotter platform may be articulated to a vertical stowed position to clear an area on the deck for other exercises.

The spotter platforms also provide fixed receipt areas within which the weight bench is received to provide proper weightlifter positioning while minimizing any relative movement between the weight bench and the weight bar frame rack.

The present invention therefore desirable to provide a weightlifting system that will better position the spotter while spotting the weightlifter

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
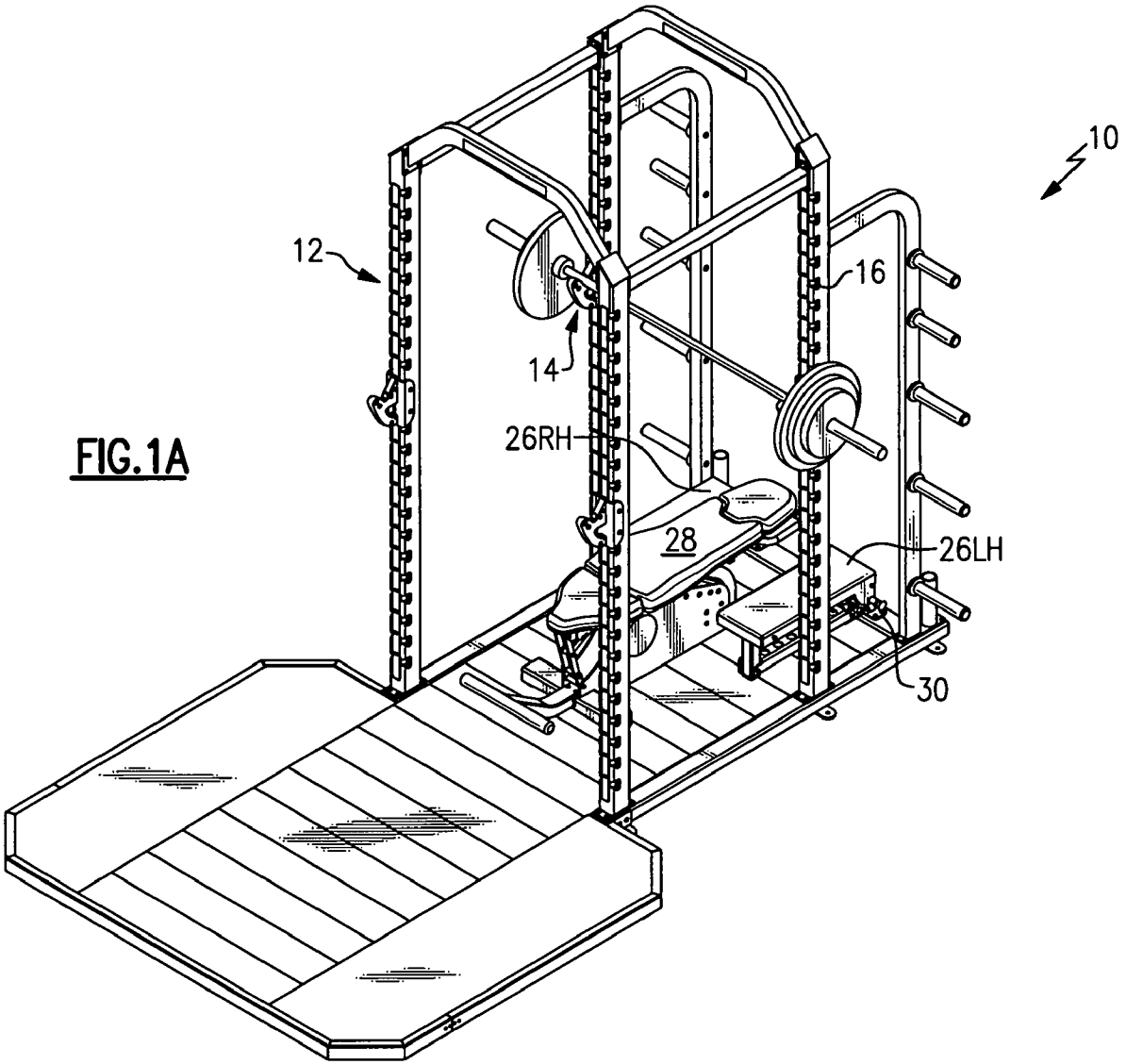
FIG. 1A is a perspective view of a weightlifting system with a spotter platform system attached thereto.

FIG. 1A illustrates an exploded view of a weightlifting system 10 which includes a weight bar frame rack 12 and weight support assembly 14 (two shown) for attachment thereto. It should be understood that although a particular frame arrangement is illustrated in the disclosed embodiment, other arrangements will be usable with the present invention.

The weight support assembly 14 supports the weight bar between sets as generally understood. For further understanding of other aspects of the rack system, attachment thereto and associated components thereof, attention is directed to U.S. patent application No. 11/326,099 filed Jan. 5, 2006 and entitled: WEIGHTLIFTING SUPPORT ASSEMBLY which is assigned to the assignee of the instant invention and which is hereby incorporated herein in its entirety.

The frame rack 12 includes a multitude of openings O along an upright frame member 16 which receive the weight support assembly 14 such that the support assembly 14 may be located at various positions along the frame rack 12. Each opening O is separated from the next by approximately four inches to provide significant incremental adjustment, however, any separation will be usable with the present invention.

Figure 2:
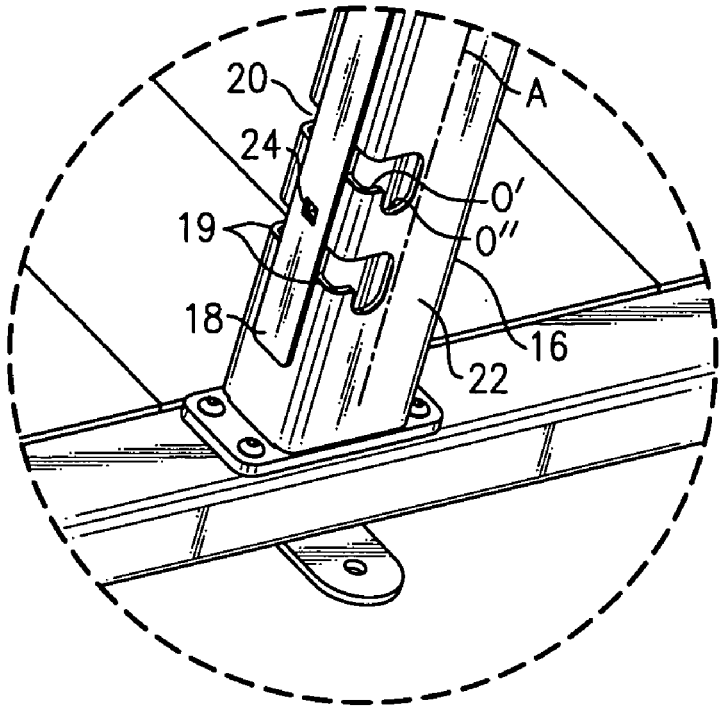
FIG. 2 is an expanded view of the weightlifting frame rack of FIGS. 1A and 1B.
Figure 3:
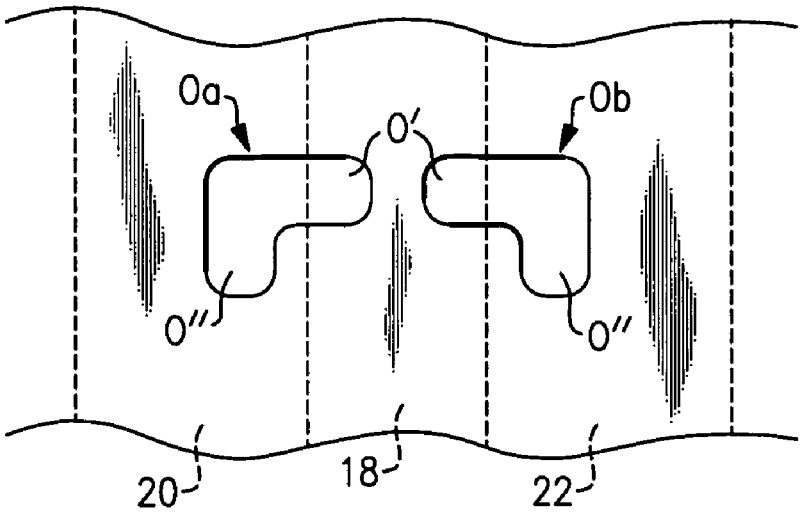
FIG. 3 is a schematic view of an opening in a weightlifting system frame rack upright.

Each upright frame member 16 defines a longitudinal axis A which extends vertically relative to the ground. The upright frame member 16 is generally rectilinear in shape and is preferably manufactured of tubing which is rectangular or U-shaped in cross-section. The upright frame member 16 includes a front face 18 and a first and second side face 20, 22 (FIG. 2). Each opening O spans the intersection of the front face 18 and one of the side faces 20, 22. In other words, each opening O cuts through the corner of the upright frame member 16. Each opening O includes a first opening portion O' in the front face 18 generally transverse to the longitudinal axis A and a second opening portion O" through the respective side face 20, 22 generally parallel to the longitudinal axis A. That is, the opening portions O' and O" are generally perpendicular if laid flat (FIG. 3). Preferably, each opening O includes relatively large corner radiuses.

The openings O are arranged in horizontally opposed pairs of openings Oa, Ob perpendicular to the longitudinal axis A. That is, each pair of openings O includes a first opening Oa located through the front face 18 and the first side face 20 and a second opening Ob located through the front face 18 and the second side face 22 such that the openings Oa, Ob are aligned when viewed from one of the side faces 20, 22.

A lock opening 24 is located through the front face 18 between each vertically separated pair of openings Oa, Ob. Each lock opening 24 is displaced parallel to the longitudinal axis A and is generally square in shape. It should be understood that other shapes will also be readily usable with the present invention. Preferably, the lock opening 24 is longitudinally staggered above each pair of openings Oa, Ob.

A spotter platform 26 is located adjacent each upright frame member 16 to flank a weight bench 28. Each spotter platform 26 is preferably attached to a deck 30 between the upright frame members 16 and may be articulated to a vertical stowed position (FIG. 1B) to clear the deck 30 for other exercises such as "squats" and the like. The spotter platforms 26 provide a surface raised above the deck 30 upon which a spotter may stand. The spotter platforms 26 provide a more comfortable position for both the spotter and the weightlifter while providing a leverage advantage to the spotter such that the spotter may more readily lift with his legs during spotting of the weightlifter. The spotter platforms 26 also provide fixed receipt areas within which the weight bench 28 is received to provide proper weightlifter positioning while minimizing any relative movement between the weight bench 28 and the weight bar frame rack 12 as will be further described.

Figure 4A:
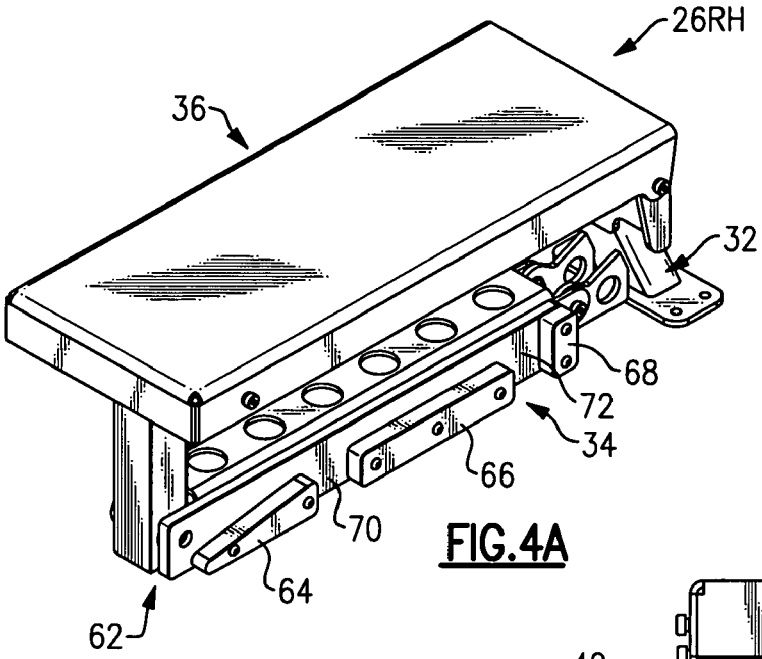
FIG. 4A is a perspective view of a spotter platform according to the present invention.

Referring to FIG. 4A, a right hand spotter platform 26RH is illustrated. Although the right hand spotter platform 26RH is illustrated in the disclosed embodiment, it should be understood that the left hand spotter platform 26LH spotter platform is generally of the same construction and provides the same benefits such that a separate discussion thereof need not be provided.

Figure 1B:
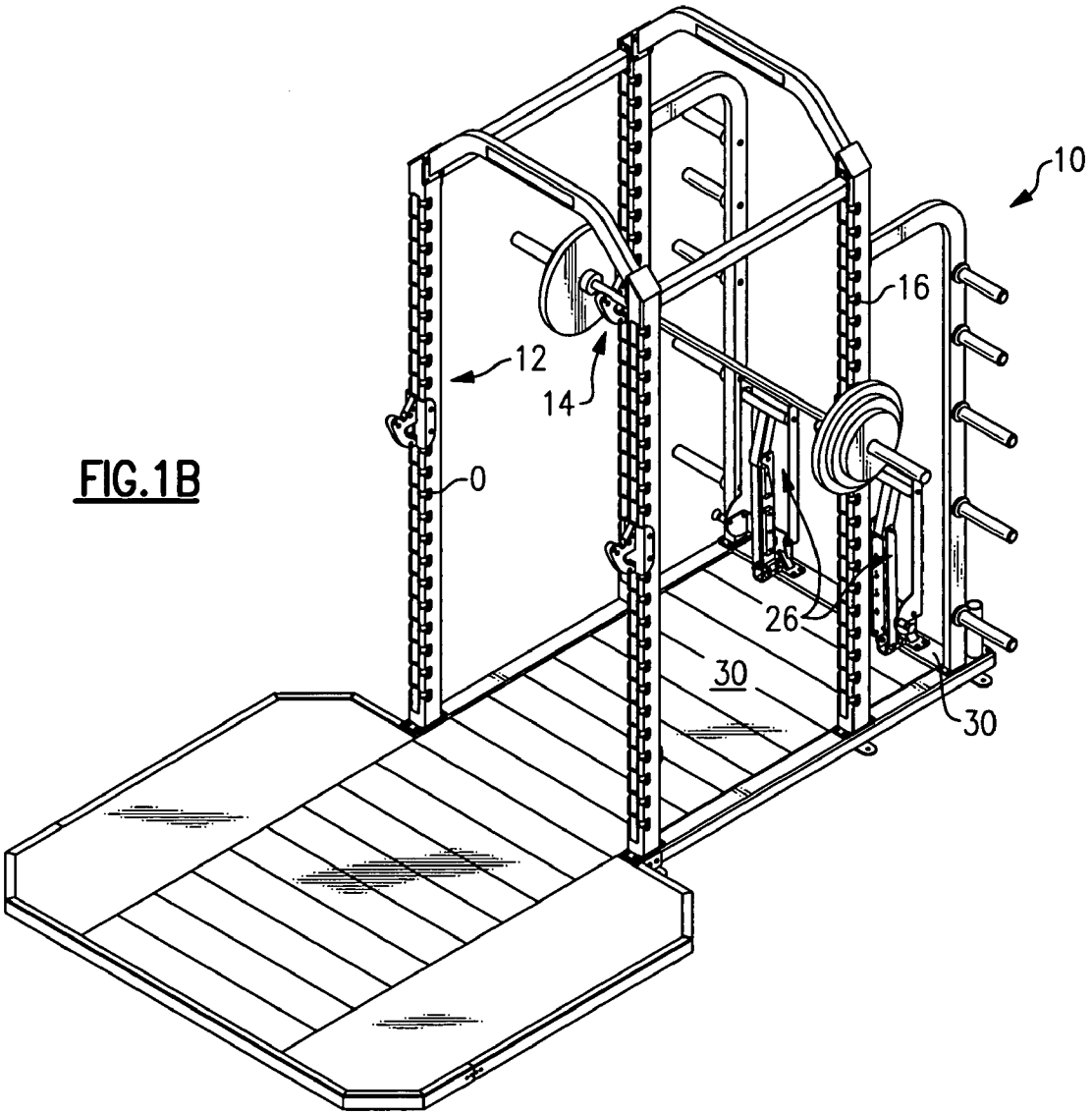
FIG. 1B is a perspective view of a weightlifting system with the spotter platform shown in FIG. 1A placed in a stowed position.
Figure 4C:
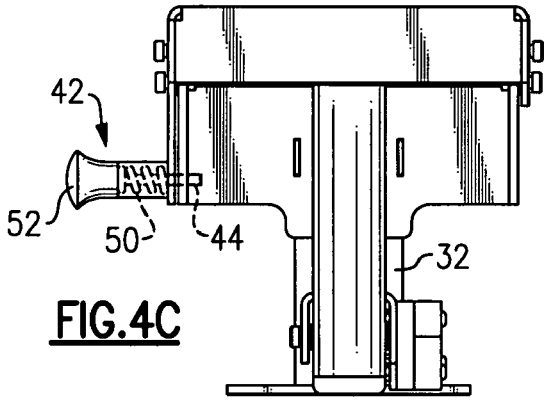
FIG. 4C is a front view of the spotter platform illustrated in FIG. 4A.
Figure 4B:
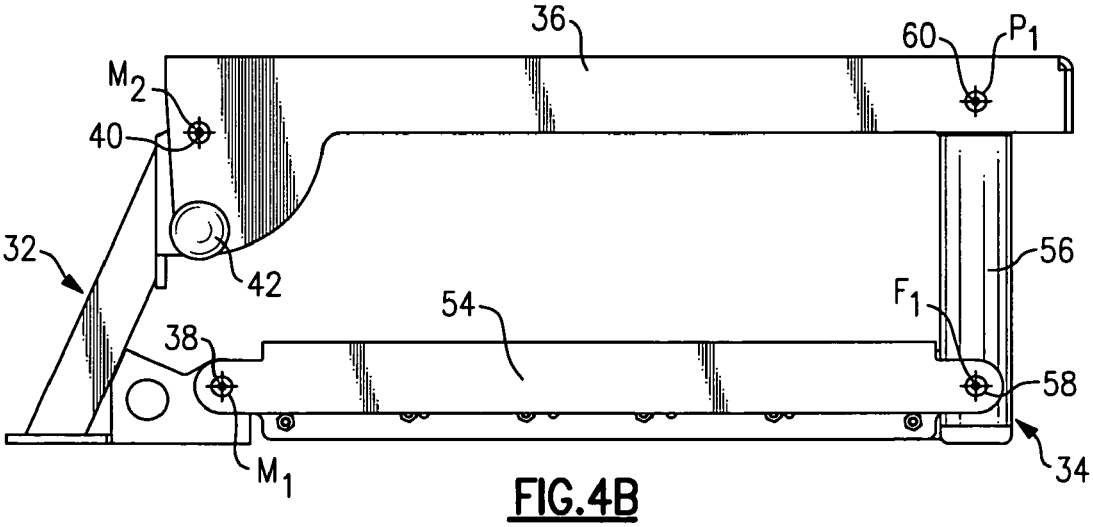
FIG. 4B is a side view of the spotter platform illustrated in FIG. 4A.
Figure 5A:
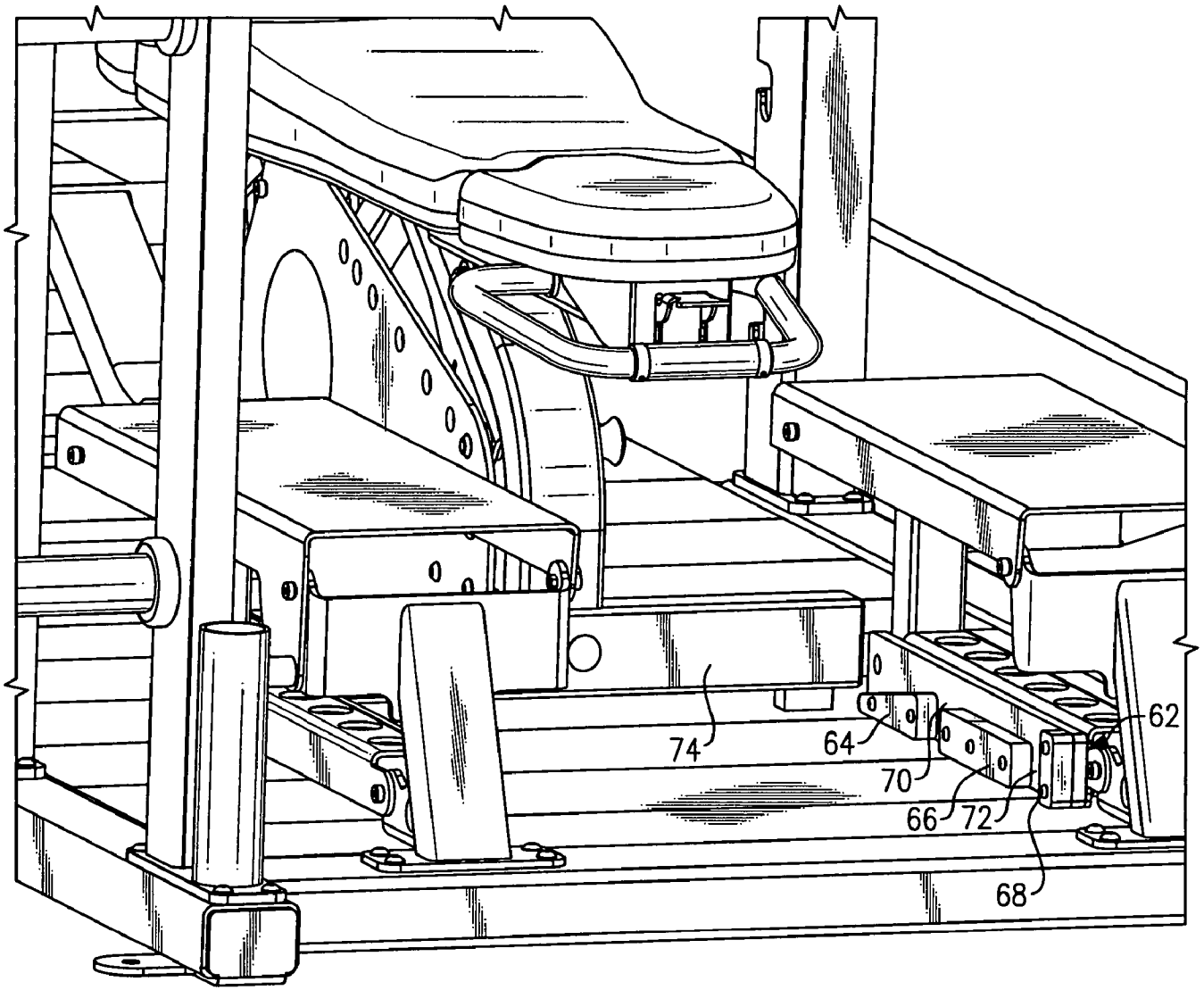
FIG. 5A is a perspective view of a weight bench prior to being docked to the spotter platforms.
Figure 5B:
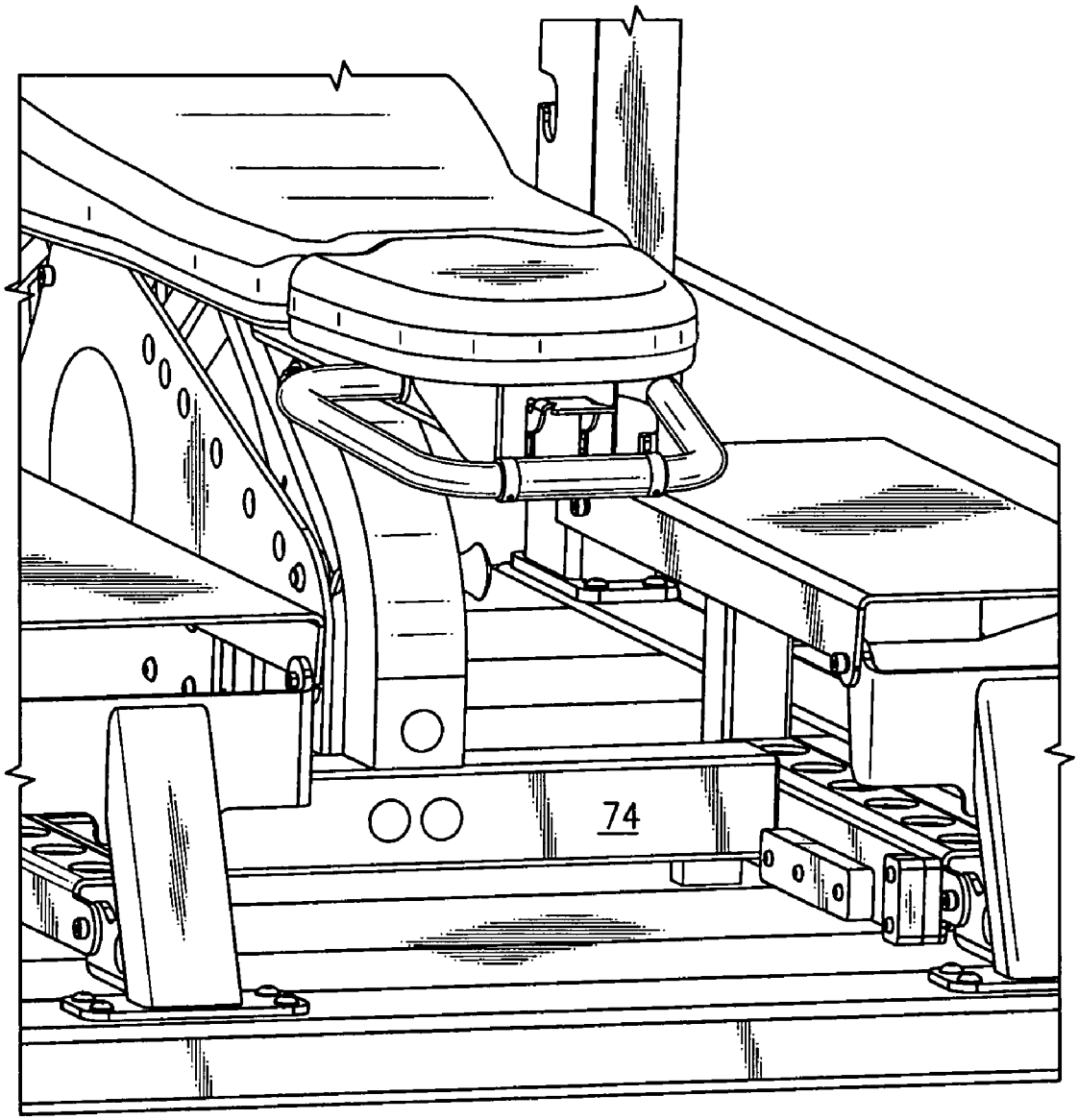
FIG. 5B is a perspective view of the weight bench docked in a first position as defined by the spotter platforms.

The spotter platform 26RH generally includes a mount 32, a frame assembly 34 and a platform 36 mounted to the frame assembly 34 and mount 32 (also illustrated in FIG. 5B). The mount 32 is attached to the deck 30 through bolts or like to provide a fixed attachment for the spotter platform 26RH, 26LH (FIGS. 1A and 1B). The mount 32 is pivotally attached to the frame assembly 34 at a first mount pivot 38 and to the platform 36 at a second mount pivot 40 (FIG. 4B) through a bolt or a pin which defines a first and a second mount axis of rotation M1, M2. It should be understood that various axles or pivot pin arrangements which attach the two components together while providing pivotal movement about the axis may also be utilized with the present invention.

A handle knob assembly 42 is mounted to the frame assembly 34 generally between the first mount pivot 38 and a second mount pivot 40 for engagement with the mount 32 to lock the spotter platform 26RH, 26LH in either a down position (FIG. 1A) or a stowed position (FIG. 1B). It should be understood that the spotter platform 26RH, 26LH alternatively need not be locked in the down position.

Figure 4D:
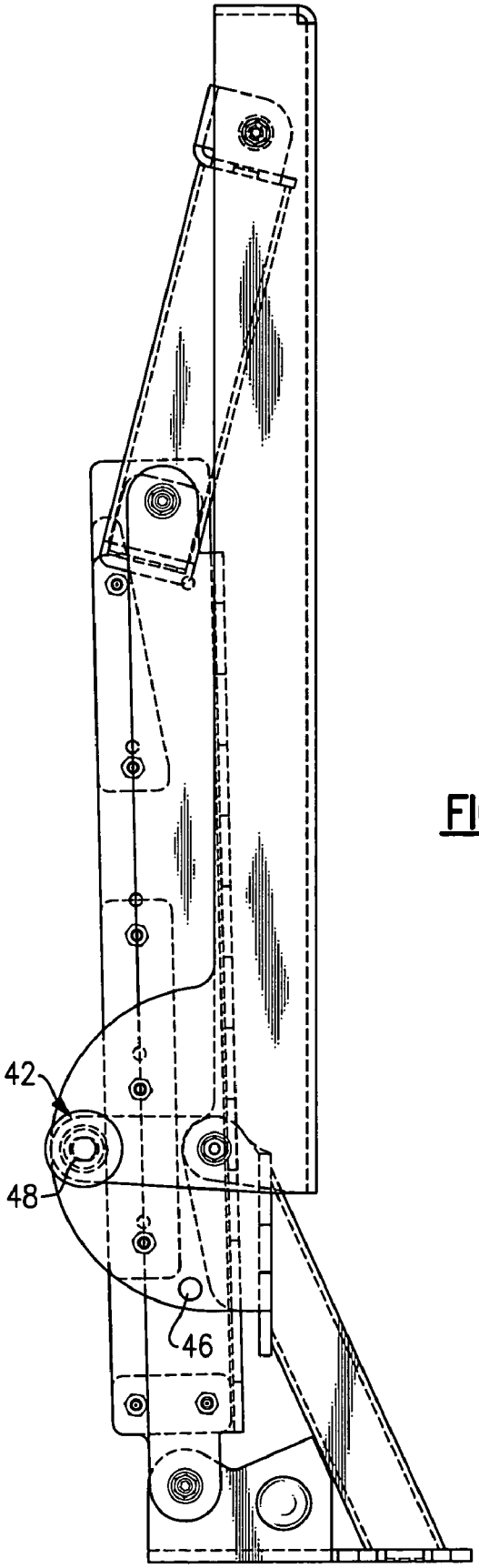
FIG. 4D is a side view of the spotter platform illustrated in FIG. 4A in a stowed position.

The handle knob assembly 42 is mounted to the frame assembly 34 such that a biased latch member 44 (FIG. 4C) extends therethrough for engagement with the mount 32 at either a down position aperture 46 or a stowed position aperture 48 formed in the mount 32 (FIG. 4D). The latch member 44 is preferably a pin which is biased by a spring 50 (FIG. 4C or the like such that the latch member 44 is engageable with either the down position aperture 46 or a stowed position aperture 48. The handle knob assembly 42 is actuated by pulling a knob 52 to retract the latch member 44 from either the down position aperture 46 or the stowed position aperture 48 such that the platform 36 is movable relative the mount 32.

Referring to FIG. 4B, the frame assembly 34 generally includes a base leg 54 pivotally attached to a support leg 56 at a pivot 58 such as a bolt or a pin which defines an axis of rotation F1. The base leg 54 is attached to the mount 32 at the first mount pivot 38. The support leg 56 is attached to the platform 36 at a platform pivot 60 such as a bolt or pin which defines an axis of rotation P1. The platform 36 is attached to the mount 32 at the mount pivot 40 such as a bolt or pin which defines the axis of rotation $M_2$.

In use, the knob 52 of the handle knob assembly 42 is pulled and the platform and frame assembly 34 are pivoted about the first mount pivot 38 and a second mount pivot 40 to move the spotter platform 26RH, 26LH between the down position (FIGS. 1A and 4A-4C) and the stowed position (FIGS. 1B and 4D). As the handle knob assembly 42 is spring biased, the latch member 44 will enter either the down position aperture 46 or the stowed position aperture 48 to thereby lock the spotter platform 26RH, 26LH into the desired position. Alternatively, the down position aperture 46 need not be provided as the platform 36 is supported by the frame assembly 34 when in the down position.

Figure 5C:
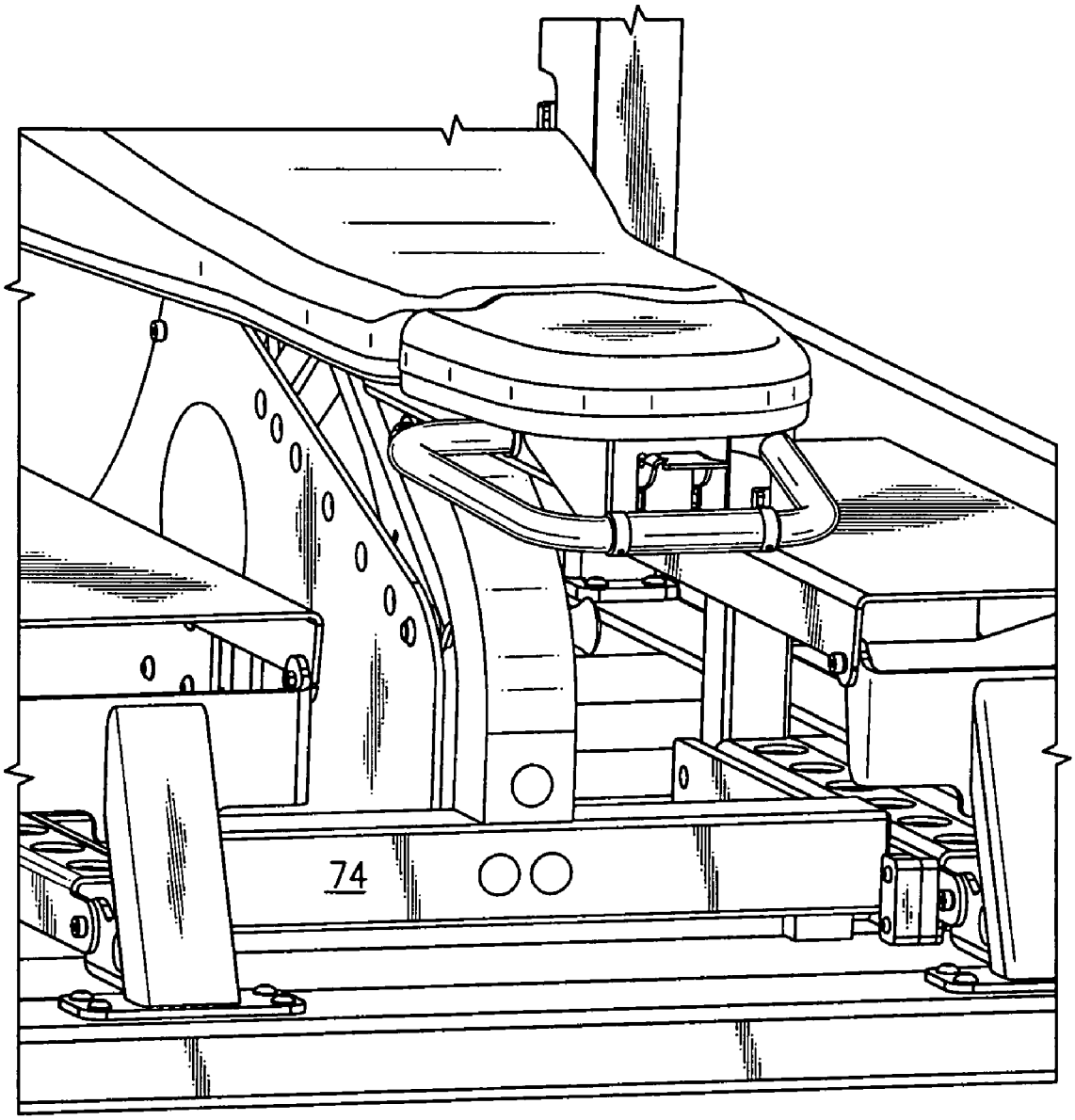
FIG. 5C is a perspective view of the weight bench docked in a second position as defined by the spotter platform.

Referring to FIGS. 4A and 5A, the inner side of the base leg 54 of the spotter platform 26RH, 26LH further includes a weight bench position system 62. The weight bench position system 62 preferably includes a front guide 64, a spacer guide 66 and a back stop guide 68 which are separated by a first space 70 and a second space 72. Preferably, the front guide 64 is generally wedge shaped to facilitate movement of the bench into the first space 70 (FIG. 5B) or the second space 72 (FIG. 5C). The first space 70 and the second space 72 provide two positions for docking of the weight bench (FIGS. 5B and 5C). It should be understood that any number of spaces may be provided.

Figure 6A:
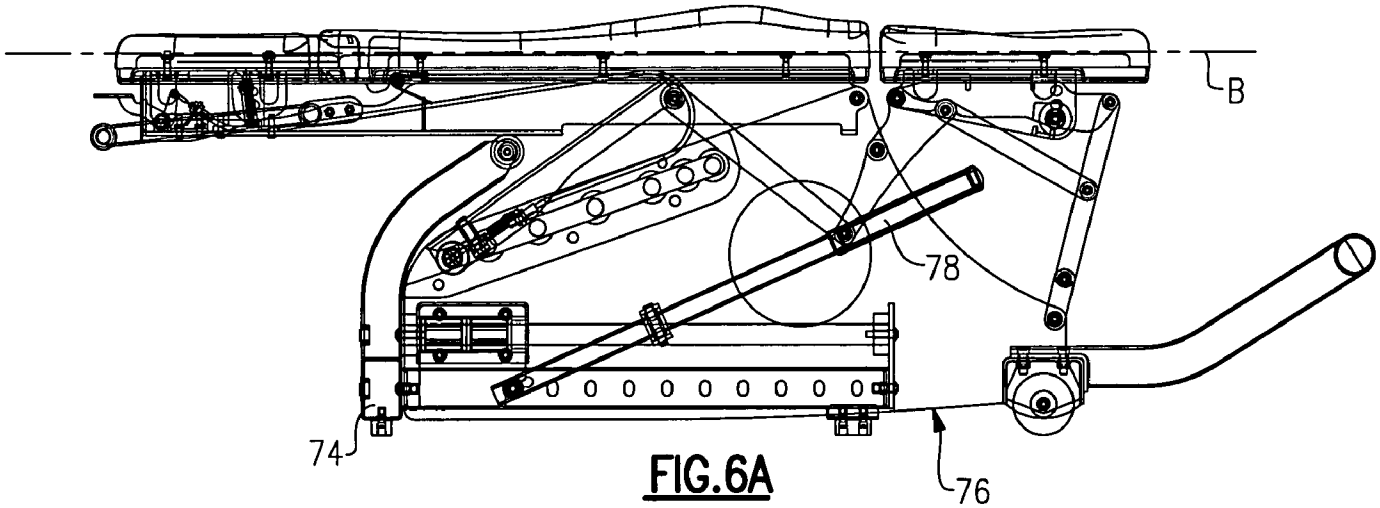
FIG. 6A is a side partially phantom view of a weight bench in a non-extended position.
Figure 6B:
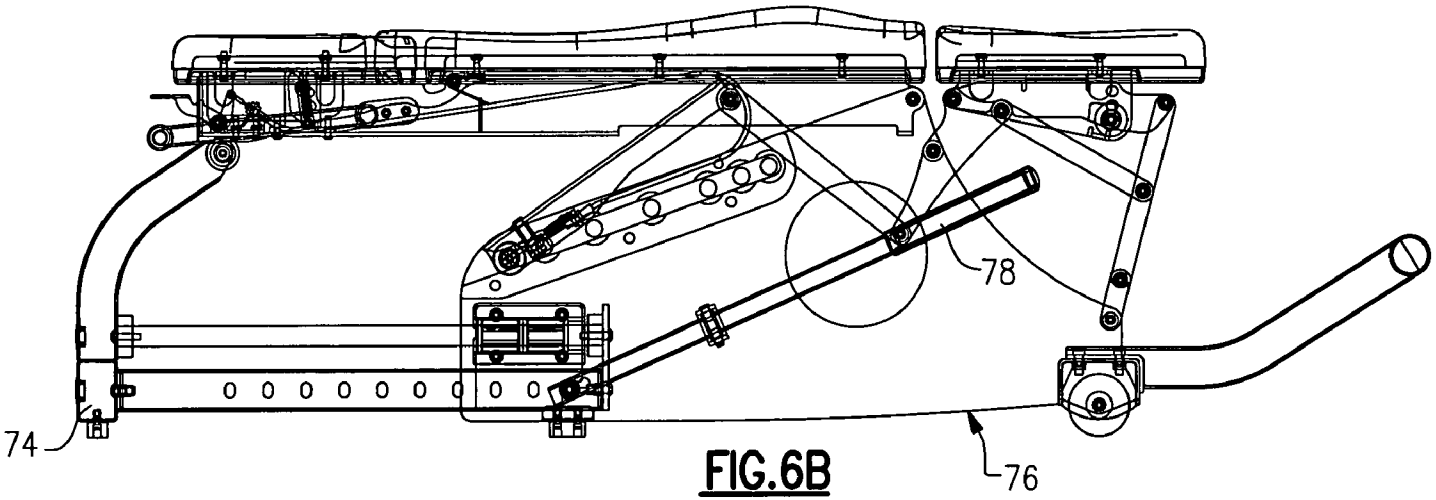
FIG. 6B is a side partially phantom view of the weight bench of FIG. 6A in an extended position.

The front guide 64, a spacer guide 66 and a back stop guide 68 are preferably non metallic members to receive a transverse leg 74 of the weigh bench 28. That is, the transverse leg 74 is generally transverse to a longitudinal axis B defined along the length of the weight bench 28. That is, the transverse leg 74 is selectively inserted into either the first space 70 or the second space 72. Once located in either space 70, 72, the weight bench 28 is then movable fore/aft. That is, the weight bench frame 76 is moveable relative the transverse leg 74 as illustrated in FIGS. 6A and 6B. A side handle 78 preferably allows the weight lifter to move the weight bench 28 to properly position himself under the weight bar. In one embodiment, the weight bench 28 can move 17 inches total travel. There are 10 positions within the 17 inch window as illustrated in FIGS. 6A and 6B so as to provide relatively significant positional ability for the weightlifter heretofore unavailable. For further understanding of other aspects of the weight bench system, attention is directed to U.S. patent application No. 11/326,099 filed Jan. 5, 2006 and entitled: WEIGHTLIFTING BENCH WITH SYNCRONIZED BACKREST AND SEAT which is assigned to the assignee of the instant invention and which is hereby incorporated herein in its entirety.

It should be understood that relative positional terms such as "forward," "aft," "upper," "lower," "above," "below," and the like are with reference to the normal operational attitude and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A weightlifting system comprising:

a weight bar frame rack; and a spotter platform mountable to said weight bar frame rack, said spotter platform to provide a generally planar platform upon which a spotter may stand when said spotter platform is at a down position; wherein the spotter platform is moveable between said down position and a stowed position.

2. The system as recited in claim 1, further comprising a weight bench engageable with said spotter platform.

3. The system as recited in claim 1, wherein said platform includes a generally planar member as a top surface thereof.

4. The system as recited in claim 1, wherein said platform is generally rectilinear.

5. A method of positioning a weight bench relative a weight bar frame rack comprising the step of:

selectively moving a spotter platform between a stored position to a down position; and removably docking a weight bench to at least one position defined by the spotter platform when the spotter platform is in the down position.

6. A method as recited in claim 5, further comprising the step of:

adjusting the weight bench in a fore/aft direction relative the spotter platform.

7. A method as recited in claim 5, further comprising:

positioning the stored position generally parallel to an upright frame member of the weight bar frame rack.

8. A method as recited in claim 5, further comprising:

docking the weight bench to one of a multiple of positions defined by the weight bench.

9. A weightlifting system comprising:

a weight bar frame rack; and a spotter platform mountable to said weight bar frame rack, said spotter platform comprising:

a first mount;

a first frame assembly pivotally mounted to said mount;

a first platform pivotally mounted to said frame and said mount, said frame and said platform movable between a down position and a stowed position relative to said mount;

a second mount;

a second frame assembly pivotally mounted to said second mount;

a second platform pivotally mounted to said second frame and said second mount, said second frame and said second platform movable between a down position and a stowed position relative to said second mount.

10. The system as recited in claim 9, further comprising a weight bench engageable with said first frame assembly and said second frame assembly.

* * * * *